United States Patent [19]

Garland

[11] Patent Number: 4,840,033

[45] Date of Patent: Jun. 20, 1989

[54] ICE BUILDER AND CONTROL SYSTEM THEREFOR

[75] Inventor: Milton W. Garland, Waynesboro, Pa.

[73] Assignee: Frick Company, Waynesboro, Pa.

[21] Appl. No.: 208,677

[22] Filed: Jun. 20, 1988

[51] Int. Cl.[4] ..... F25D 3/02

[52] U.S. Cl. ..... 62/59; 62/139

[58] Field of Search ..... 62/59, 139, 138

[56] References Cited

U.S. PATENT DOCUMENTS

| | | | |
|---|---|---|---|
| 1,823,106 | 9/1931 | King | 62/59 |
| 1.869,917 | 8/1932 | Schmieding | 62/59 |
| 1,954,695 | 4/1934 | Garland | 62/126 |
| 2,021,052 | 11/1935 | Dickey | 62/59 |
| 2,039,796 | 5/1936 | Hiller | 62/512 |
| 2,246,401 | 6/1941 | Waterfill et al. | 62/59 |
| 2,249,856 | 7/1941 | Ruff | 62/95 |
| 2,308,079 | 1/1943 | Henney | 62/6 |
| 2,503,212 | 4/1950 | Patterson | 62/509 |
| 2,722,108 | 11/1955 | Hailey | 62/7 |
| 3,484,805 | 12/1969 | Lorenz | 62/59 |
| 3,552,136 | 1/1971 | Cook | 62/139 |
| 3,653,221 | 4/1972 | Angus | 62/59 |

OTHER PUBLICATIONS

1987 Ashrae Handbook-Heating, Ventilating and Air--Conditioning Systems and Applications—(Chaper 46).

*Primary Examiner*—William E. Tapolcal
*Attorney, Agent, or Firm*—Dowell & Dowell

[57] ABSTRACT

An ice builder coil has two or more coil sections, one above the other, supplied with refrigerant from a low pressure receiver, each coil section having an individual vapor return line to the low pressure receiver, the flow through the lower coil section being controlled by an ice thickness sensor associated with the lower coil section.

15 Claims, 2 Drawing Sheets

FIG.3a
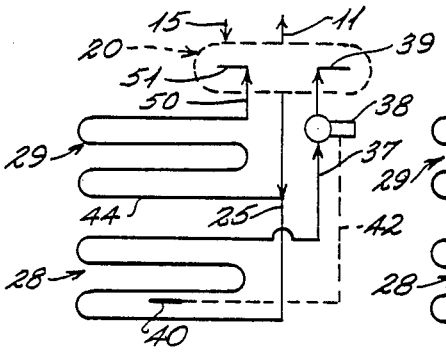
FIG.3b
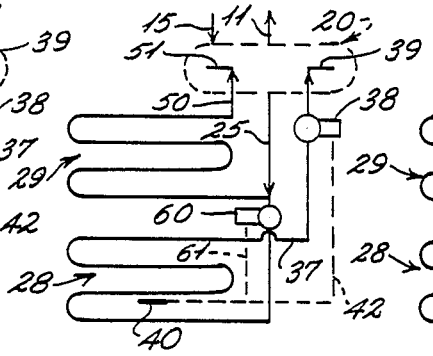
FIG.4a
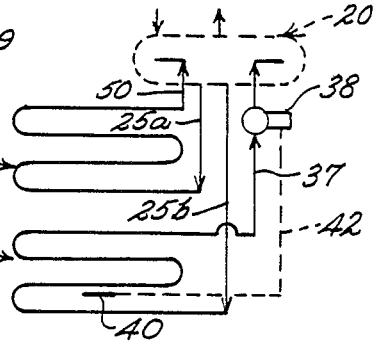
FIG.4b
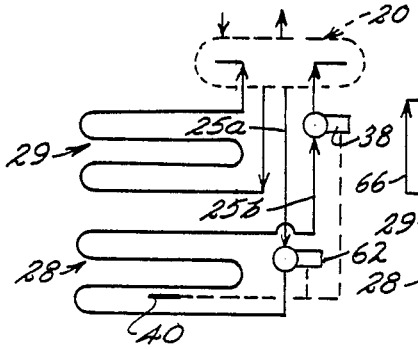
FIG.5a
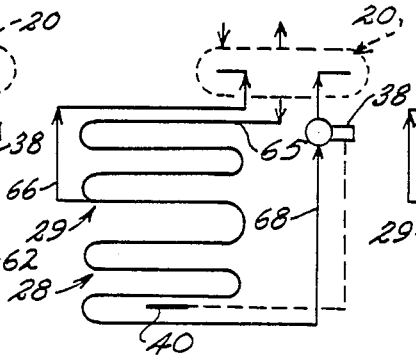
FIG.5b
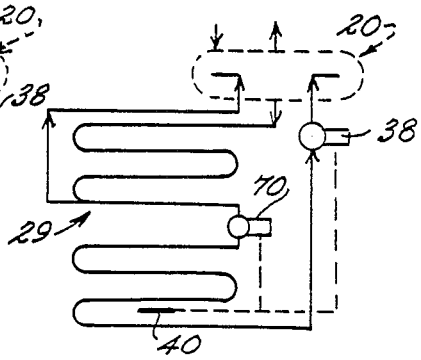
FIG.6a
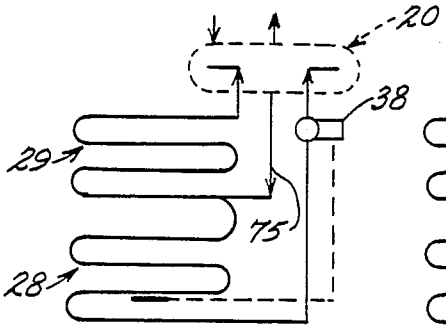
FIG.6b
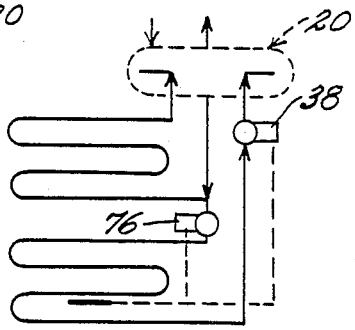
FIG.7a
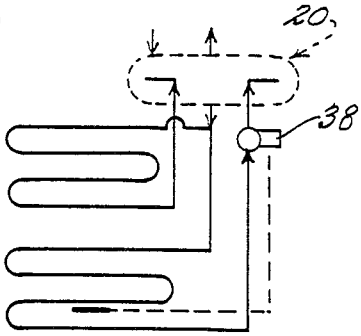
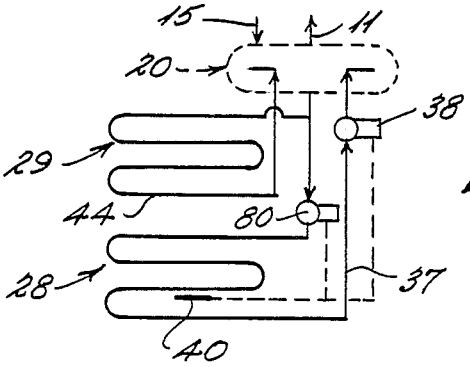
FIG.7b

ICE BUILDER AND CONTROL SYSTEM THEREFOR

BACKGROUND OF THE INVENTION

1. Field of the Invention

This invention relates to thermal storage systems and more particularly to an ice storage system of the kind used for the mechanical cooling of office buildings, theaters, churches and the like, such storage systems being commonly known as ice builders. By operating such an ice storage system to produce a storage of refrigeration in the form of ice during off peak electrical loads, a reduction in the cost of electrical energy may be achieved. Furthermore, the size of the refrigeration equipment which would otherwise be required for meeting peak demands may be reduced.

2. Description of the Prior Art

The concept of thermal storage by means of ice has been in use for a long time. In the dairy industry, which requires a large heat removal to cool milk in a short period of time, ice has been used to transfer heat from the milk into the cold water side of a heat exchanger, the water returning to the tank and being re-cooled by ice melting. This concept has carried over and is now in substantial use in the air conditioning industry.

The U.S. Pat. No. 3,484,805 to Lorenz discloses an ice bank builder having an ice thickness sensor for controlling the supply of refrigerant to the ice bank.

The U.S. Pat. No. 2,246,401 to Waterfill et al. discloses a refrigeration system in which high side liquid is supplied to a lower ice builder coil and to an upper water chilling coil.

The U.S. Pat. No. 2,722,108 to Hailey discloses an ice builder which is supplied by refrigerant from the high side of a refrigeration system and having an ice thickness detector for controlling the flow of refrigerant thereto.

The U.S. Pat. No. 3,653,221 to Angus discloses an ice builder having a plurality of separate coils arranged side by side and with separate control circuits therefor, supplied from the high side of a refrigeration system.

The U.S. Pat. No. 2,503,212 to Patterson discloses a plurality of cooling coils, each mounted on a separate floor of a building, the coils being supplied with refrigerant from a low pressure receiver, the vapor from the coils being returned thereto, and having individual control means on the respective return lines.

The U.S. Pat. No. 1,954,695 to Garland discloses a refrigerant circuit in which a low pressure receiver or accumulator supplies refrigerant by gravity flow to a coil, the refrigerant vapor being returned to the low side receiver.

The U.S. Pat. No. 2,039,796 to Hiller discloses chilling apparatus in which liquid refrigerant is pumped from a low side receiver or accumulator to a series of coils, the vapor then returning to the low side receiver.

The U.S. Pat. Nos. 1,823,106, to King, 1,869,917, to Schmieding and 2,021,052 to Dickey disclose refrigeration systems having plural evaporator sections for producing different temperature levels, the evaporator sections being connected to a common high side of a refrigeration system.

The U.S. Pat. No. 2,308,079 to Henney discloses in FIG. 2 an evaporator having parallel sections connected to the high side of a refrigeration system for the purpose of meeting different refrigeration requirements.

The U.S. Pat. No. 2,249,856 to Ruff discloses an air conditioning system having a pair of evaporator coils connected in parallel in a cooling duct, the coils being connected to the high side of a refrigeration system.

The 1987 Ashrae Handbook for Heating, Ventillating, and Air Conditioning Systems and Applications, at pages 46.22 and 46.23, discloses an ice builder including a pair of coils mounted in parallel, the coils being positioned in separate tanks, and connected to a low pressure receiver, each coil having a solenoid control valve between the coil and the low pressure receiver for controlling the flow of liquid refrigerant thereto.

In an ice building coil for thermal storage purposes, sufficient ice must be formed to provide the necessary storage of energy. However, if the ice bridges over from one coil to the other, this interferes with the free flow of heat transfer liquid through the ice and therefore impedes the transfer of energy. Attempts have been made to meet this problem by providing an ice sensor at appropriate locations on the coil and shutting off the flow of refrigerant when the ice thickness reaches a predetermined amount.

Furthermore, in some systems, such as that disclosed in the 1987 Ashrae publication, referred to above, the feed of refrigerant has been from the top of the coil to the bottom, on the theory that the tendency of the ice to build from the bottom of a coil will be overcome. However, the problem with this and other systems has been that the liquid refrigerant in the coil flows to the bottom during normal operation; furthermore, when the flow is shut off, any liquid remaining in the coil gravitates to the bottom thereof and in a sufficient amount to continue ice building, resulting in ice bridging.

Thus, regardless of the type of refrigerant feed, whether from top to bottom, bottom to top, gravity flooded or thermal expansion valve control, in vertical serpentine coils there has always been the problem of greater ice thickness at the bottom pipes than those at the top pipes. The result has been that in all such coil systems, the ice builds first on the bottom pipes of a coil and very often such ice bridges over the coils and instead of individual ice covered pipes, there exists a massive block of ice in the bottom area of the tank. Such ice building greatly reduces the exposed surface of the ice and therefore prevents a fast melt down when maximum cooling is required from the recirculated heat transfer water.

SUMMARY OF THE INVENTION

Accordingly, it is an object of the invention to obtain as nearly as possible an even ice thickness on all pipes in vertically positioned serpentine ice building coils.

A further object of the invention is to obtain an even ice thickness on serpentine ice building coils by stopping, as completely as possible, all refrigeration in the lower sections of the coils when the lower sections have reached a predetermined ice thickness and to stop all ice making when the final predetermined ice thickness is obtained on the upper pipes as well as the lower pipes.

A further object of the invention is to provide an ice builder which produces as nearly as possible an even ice thickness on all the pipes in order to obtain the maximum and required melt down during peak air conditioned loads in a coil type refrigeration ice storage system.

The objects mentioned above are accomplished by dividing each vertical serpentine coil into a plurality of sections at different levels, supplying the sections with liquid refrigerant from a low pressure receiver through, optionally, a common line, and providing a return line from each section individually to the low pressure receiver, in which an individual ice thickness sensor is provided for each of the sections and the vapor return from each lower section is controlled by its individual ice sensor, thereby shutting off the refrigeration of each lower section in response to the ice thickness. In addition, in a preferred embodiment, the remaining refrigerant in a lower section may be driven into the next uppermost section when the lower section shuts off.

Furthermore, in an upper section of the coil an ice thickness sensor is provided which controls the operation of the refrigerant producer, e.g. the compressor, in order to shut down operation of the ice making system when the requirements for ice storage have been met.

BRIEF DESCRIPTION OF THE DRAWINGS

FIG. 3*a* is a diagram of the coil arrangement of FIGS. 1 and 2 and its control valve on the lower coil return line.

FIG. 3*b* is a diagram like FIG. 3*a* with the addition of a control valve on the refrigerant liquid feed line to the lower coil.

FIGS. 4*a*, 5*a*, 6*a* and 7*a* are diagrams of modified coil arrangements and their control valves on the lower coil return line; and FIGS. 4*b*, 5*b*, 6*b* and 7*b* are diagrams like FIGS. 4*a*, 5*a*, 6*a* and 7*a*, respectively, with the addition of a control valve on the liquid feed line to the lower coil.

DESCRIPTION OF THE PREFERRED EMBODIMENT

Figure 1:
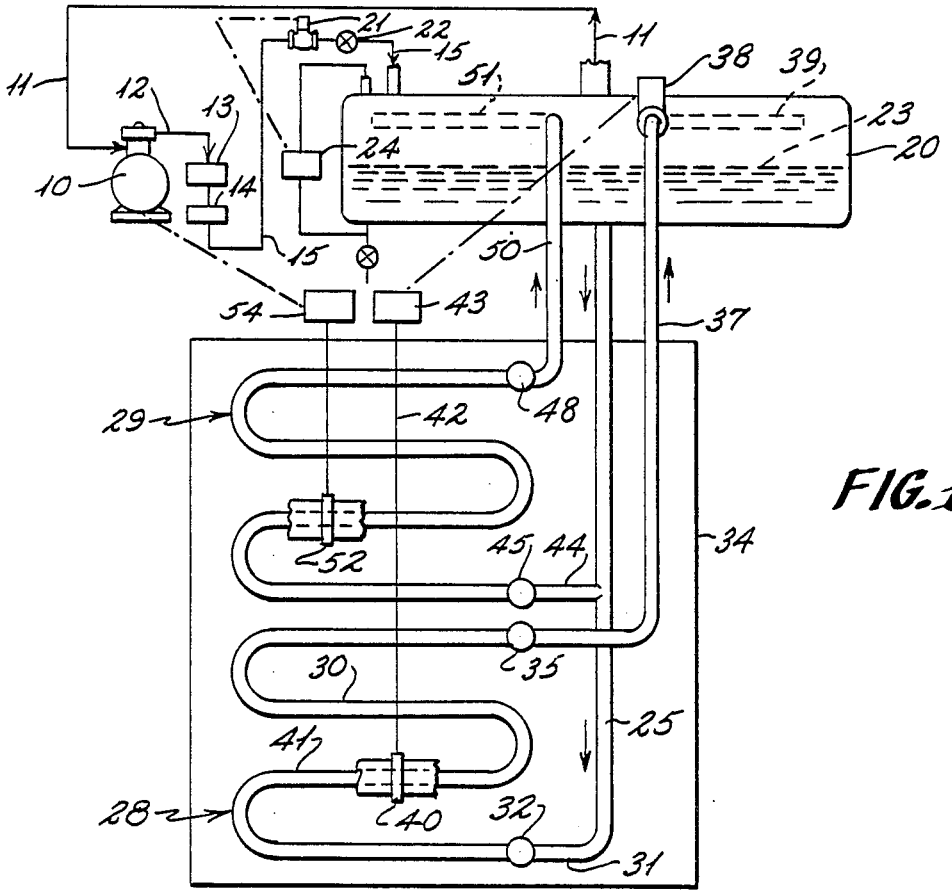
FIG. 1 is a side elevation of an ice builder system in accordance with the invention and illustrating its connection to a refrigeration producer, illustrated schematically.

With further reference to the drawings, there is disclosed a compressor 10 having a suction line 11 and a discharge line 12, a condenser 13 and receiver 14. The receiver discharge line 15 is connected to a low pressure receiver or accumulator-separator 20 through a solenoid controlled valve 21 and shut-off valve 22. The liquid level 23 in the accumulator 20 is controlled by a float valve 24 that is connected to control the valve 21.

The accumulator 20 has a gravity feed line 25 to a lower coil 28 and an upper coil 29, each of which has a plurality of runs 30 connected in serpentine fashion.

Coil 28 has an inlet line 31 that is connected to a lower coil header 32 serving a plurality of coil sections 33 arranged vertically and in side by side relation in a tank 34. The coil 28 has an upper header 35 which is connected to a return line 37 through a shut-off valve 38 to return pipe 39 above the liquid level in the accumulator 20. The shut-off valve 38 is connected to an ice thickness sensing thermostat 40 associated with a lower run 41 of the coil 28. The thermostat 40 is connected by lead 42 to a control 43 for the shut-off valve 38.

Similarly, the upper coil 29 has an inlet 44 to a lower coil header 45 connected to individual serpentine coils 46 and having an upper header 48 connected to a return line 50 to return pipe 51 located above the liquid level in the accumulator 20.

The upper coil 29 has an ice thickness sensing thermostat 52 in its lower area which is connected to a control means 54 for shutting off operation of the compressor 10 in order to stop refrigeration activity when the ice thickness on the upper coil is of sufficient depth.

It is understood that the illustrated arrangement of coils is merely exemplary, as more than two coil sections in vertical arrangement may be used if desired, the number of coils connected to the header may be varied, and the number of runs in each serpentine coil section may be varied.

In the operation of the device when the ice thickness sensing thermostat 40 on the lower coil section indicates that the ice thickness has reached its predetermined value, this will cause the shut-off of the valve 38 from the lower coil section. Despite this, enough liquid refrigerant will remain in the lower portion of the coil 28 to cause additional ice building. However, the heat input into the coil assembly 28 will raise the refrigerant pressure in that area of the coil since the return line 37 is closed. Such increased pressure will drive the liquid in the lower coil section upwardly in the line 25 into the upper coil section 29 by means of the inlet pipe 44 and header 45. Thus, the ice buildup on the lower coil section will be stopped before it bridges over.

In the event that the coil is divided into three vertical sections, instead of two as illustrated, the arrangement is a continuation of FIG. 1. Thus, the lowermost coil section will shut off first and its liquid will be drawn up into the next uppermost or intermediate coil. Then, when the intermediate coil is shut off, its liquid is driven up into the uppermost coil, as previously described. As previously stated, the number and arrangement of coils may be varied to suit engineering and economic requirements.

It will also be apparent that the ability and the time required for the increased pressure in a shut off coil to drive a sufficient amount of the remaining liquid into an upper coil, or into the accumulator, to stop refrigeration in the lower part of the coil, will depend on engineering parameters including the heat load on the remaining liquid refrigerant and the head that must be overcome for the liquid refrigerant to move upwardly to the required height.

Figure 2:
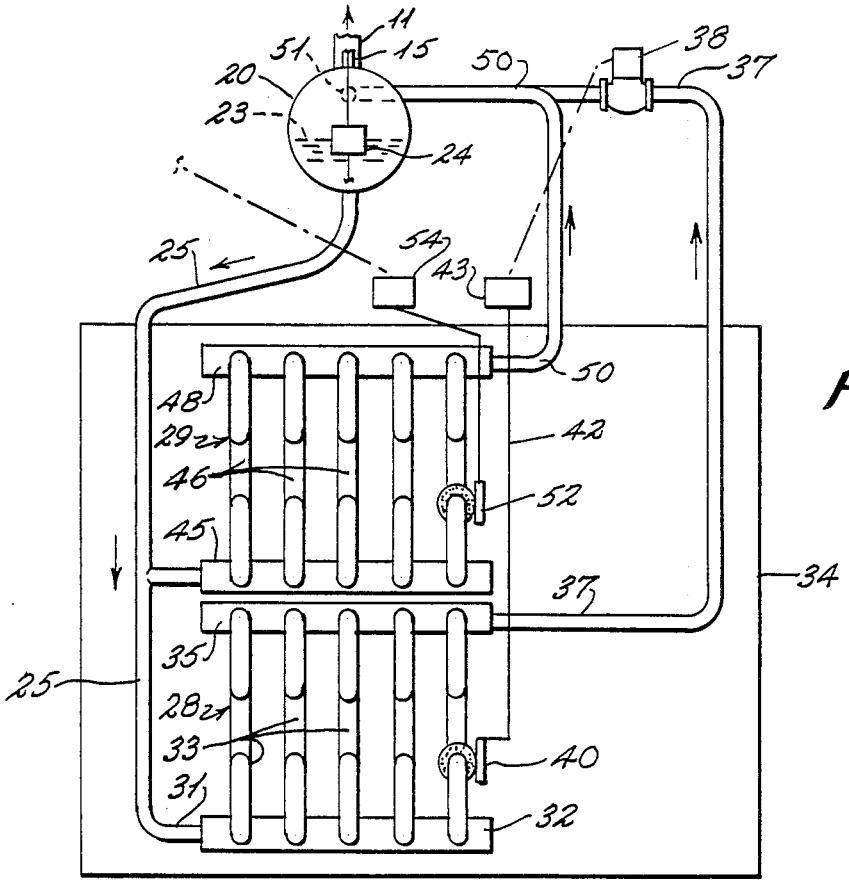
FIG. 2 is a front elevation.

FIGS. 3*a*–7*a* and 3*b*–3*b* disclose various arrangements of coils and the controls therefor. FIG. 3*a* discloses the coil and arrangement of FIGS. 1 and 2, as previously stated. In FIG. 3*b*, a solenoid valve 60 is mounted in the liquid line 25 to the lower coil 28, below the level of the upper coil 29, such solenoid valve being controlled by an electrical connection 61 to the ice sensor thermostat 40.

In the operation of the device of FIG. 3*b*, when the ice thickness has reached a predetermined amount, the valves 38 and 60 shut off the lower coil both on its inlet and outlet, thereby stopping the refrigerating effect of the coil. While the arrangement of 3*b* accomplishes the purpose of stopping refrigeration in the lower coil, it requires the additional valve, and such valve must be located underwater since it is below the level of the upper coil, and such location may present maintenance problems.

In the modification of FIG. 4*a*, the liquid feed line is divided into two sections 25*a* and 25*b*, section 25*a* feeding the upper coil 29 and section 25*b* feeding the lower coil 28. When the solenoid 38 shuts off the return to the accumulator and thereby stops refrigeration in the lower coil, any liquid remaining is driven up the pipe 25*b* into the accumulator itself instead of into the coil 29. Since the accumulator is at a greater height than the coil 29, the pressure required is increased, thereby delaying the movement of the refrigerant upwardly into the accumulator.

In the form as indicated in FIG. 4*b*, a solenoid valve 62 is mounted on the down pipe 25*b*. In this case, the lower coil 28 is controlled by both solenoid valves 38 and 62 in order to have refrigeration therein stopped. This does, however, require the additional valve 62.

In the modification of FIG. 5*a* a down pipe 65 provides liquid from the accumulator-separator to the upper coil 29 which has a return line 66 to the accumulator. At the lower portion of the upper coil, the feed continues into the lower coil 28, the outlet from which is at the lower portion thereof to the return pipe 68 to the accumulator. Since the arrangement of FIG. 5*a* provides an unbalanced feed to the two coil sections, situations in which it would be preferred are limited. When the ice sensor 40 in FIG. 5*a* responds or controls the solenoid valve 38, this will result in shutting off refrigeration in the lower coil. For additional control, as illustrated in FIG. 5*b*, a solenoid valve 70 may be placed in the line to the coil 28 just beneath the coil 29. Here again, there is a disadvantage in locating such valve beneath the water.

FIGS. 6*a* and *b* illustrate a bottom feed for the top coil section and a top feed for the bottom coil section, thereby producing an unbalanced flow which may not be desirable. The liquid inlet line 75 from the accumulator is connected to the bottom run of the coil 29 and to the top run of the coil 28. Here again, operation of the control valve 38 to shut off the return line to the accumulator will result in stopping the refrigeration effect in the lower coil section and driving the refrigerant that may be remaining into the upper coil section.

In FIG. 6*b* a solenoid valve 76 has been placed on the line from the liquid line to the lower coil section just beneath the upper coil section in order to shut off or to isolate the lower coil section and thereby stop refrigeration. Since the valve 76 must be mounted beneath the water level, the practicality of the arrangement of FIG. 6*b* is open to question.

FIG. 7*a* and 7*b* are generally similar to FIGS. 3*a* and 3*b* except that in the FIG. 7*a* and 7*b*, the feed is to the top of the coil sections instead of to the bottom as in FIG. 3*a* and FIG. 3*b*. In an ice building apparatus, this arrangement is generally viewed as not as efficient.

In FIG. 7*b*, the feed to the bottom coil section 28 may, when the ice thickness has reached a predetermined amount, be shut off by means of a solenoid valve 80. However, since such valve must be located below the level of the water, the practicality of this arrangement is questioned.

I claim:

1. An ice builder having evaporator means in at least two sections disposed at upper and lower levels of height for disposition in a tank of water, each having an inlet and an outlet, a refrigerant accumulator for separating liquid refrigerant from vapor, means connecting said evaporator means to said accumulator below its level of liquid refrigerant, means connecting each section outlet to said accumulator above its level of liquid refrigerant, valve means in the lower level section outlet, means sensing the thickness of ice on said lower level section, means for closing said valve means in response to a predetermined ice thickness, means sensing the thickness of ice on said upper level section, means for supplying liquid refrigerant to said accumulator and withdrawing vapor therefrom, and means for discontinuing the withdrawal of refrigerant vapor from said accumulator in response to a predetermined ice thickness on said upper level coil section.

2. The invention of claim 1, in which each ice sensing means is on the lower portion of its respective section.

3. The invention of claim 1 in which said means for supplying liquid refrigerant and withdrawing vapor is a refrigeration system having a compressor, and the means for discontinuing the withdrawal of refrigerant vapor is a control means for said compressor.

4. The invention of claim 3, and means for discontinuing the supply of liquid refrigerant to said accumulator, in which the control means for the compressor is the means for discontinuing such supply.

5. The invention of claim 1, each section having an upper and a lower portion, in which the inlet of the lower level section is joined to the upper level section at the latter's lower portion.

6. The invention of claim 5, valve means in the lower level section inlet, and means for closing said lower level section inlet valve means in response to a predetermined ice thickness on said lower level sections.

7. The invention of claim 1, each section having an upper and a lower portion, in which the inlet of each section is connected to its lower portion, the inlet of the lower level section being joined to the inlet of the upper level section at the latter's lower portion.

8. The invention of claim 1, each section having an upper and a lower portion in which the inlet of each section is connected to its lower portion, the inlet of the lower level section being joined to the inlet of the upper level section at the latter's lower portion, valve means in the lower level section inlet, and means for closing said lower level section inlet valve means in response to a predetermined ice thickness.

9. The invention of claim 1, each section having an upper and a lower portion, in which the inlet of each section is connected to its upper portion, the inlet of the lower level section being joined to the inlet of the upper level section at the latter's upper portion.

10. The invention of claim 1, each section having an upper and a lower portion, in which the inlet of each section is connected to its upper portion, the inlet of the lower level section being joined to the inlet of the upper level section at the latter's upper portion, valve means in the lower level section inlet, and means for closing said lower level section inlet valve means in response to a predetermined ice thickness.

11. The invention of claim 1, in which neither the inlets nor the outlets of each section are connected together.

12. The invention of claim 1, in which neither the inlets nor the outlets of each section are connected together, valve means in the lower level section inlet, and means for closing said lower level section inlet valve means in response to a predetermined ice thickness.

13. The invention of claim 1, in which each section of the evaporator means is a coil means having a plurality of substantially horizontal runs connected vertically in series.

14. The invention of claim 1, in which each section of the evaporator means includes a vertical coil means having a plurality of substantially horizontal runs connected vertically in series, a plurality of such vertical coil means being connected by headers at their respective inlets and outlets.

15. The method of operating an ice builder having a vertical evaporator coil immersed in a tank of water, comprising introducing liquid refrigerant into said coil from a low pressure liquid storage receiver at an upper portion and at a lower portion simultaneously and through a common inlet line, withdrawing vapor simultaneously from the upper and lower portions of said coil through different outlet lines to said liquid storage receiver, sensing the ice buildup on the lower portion of said coil, closing the outlet line from the lower portion of said coil when the ice buildup reaches a predetermined amount, and discontinuing the withdrawal of vapor from the upper portion of said coil when the ice buildup on it reaches a predetermined amount.

* * * * *